US009115941B2

(12) United States Patent
Tertin et al.

(10) Patent No.: US 9,115,941 B2
(45) Date of Patent: Aug. 25, 2015

(54) STRAIGHT PULL BOLT ACTION SYSTEM

(71) Applicant: Saeilo Enterprises, Inc., Pearl River, NY (US)

(72) Inventors: James A. Tertin, Baxter, MN (US); Joseph B. Goerges, Jenkins, MN (US)

(73) Assignee: Saeilo Enterprises, Inc., Pearl River, NY (US)

( * ) Notice: Subject to any disclaimer, the term of this patent is extended or adjusted under 35 U.S.C. 154(b) by 0 days.

(21) Appl. No.: 14/215,331

(22) Filed: Mar. 17, 2014

(65) Prior Publication Data

US 2014/0311005 A1 Oct. 23, 2014

Related U.S. Application Data

(60) Provisional application No. 61/786,881, filed on Mar. 15, 2013.

(51) Int. Cl.
*F41A 3/20* (2006.01)

(52) U.S. Cl.
CPC ..... *F41A 3/20* (2013.01)

(58) Field of Classification Search
CPC ..... F41A 3/20
USPC ..... 42/14, 16, 69.02; 89/1.4, 190
See application file for complete search history.

(56) References Cited

U.S. PATENT DOCUMENTS

| | | | | | |
|---|---|---|---|---|---|
| 1,758,486 | A | * | 5/1930 | Von Frommer | 89/177 |
| 2,356,595 | A | * | 8/1944 | Koucky | 42/16 |
| 2,389,631 | A | * | 11/1945 | Moore | 89/141 |
| 2,407,157 | A | * | 9/1946 | Hyde | 89/154 |
| 2,484,694 | A | * | 10/1949 | Dicke | 42/18 |
| 2,512,027 | A | * | 6/1950 | Lippert et al. | 89/162 |
| 3,257,749 | A | * | 6/1966 | Donaldson | 42/16 |
| 4,152,855 | A | | 5/1979 | DuBiel et al. | |
| 4,213,261 | A | * | 7/1980 | Claypool | 42/16 |
| 4,358,986 | A | | 11/1982 | Giorgio | |
| 4,698,931 | A | | 10/1987 | Larsson | |
| 6,393,961 | B1 | * | 5/2002 | Ockenfuss | 89/172 |

OTHER PUBLICATIONS

Article Re: Bolt Action firearms; Wikipedia, free encyclopedia; http://en.wikipedia.org/wiki/Bolt_action; pp. 1-9, dated Jan. 8, 2013.

* cited by examiner

*Primary Examiner* — Bret Hayes
(74) *Attorney, Agent, or Firm* — Alix, Yale & Ristas, LLP

(57) ABSTRACT

A straight pull bolt action system for use with a firearm includes a bolt, an action bar, a locking pin and a locking lug. The locking lug front end is pivotally moveable between an up position and a down position, the bolt and action bar are longitudinally moveable between forward and rearward positions. The bolt has a lower locking surface that locks with the locking lug front end when the bolt is in the forward position and the locking lug front end is in the up position. The locking pin has one portion slidably disposed in an opening in the bolt and another portion slidably disposed in an L-shaped opening in the action bar.

11 Claims, 11 Drawing Sheets

STRAIGHT PULL BOLT ACTION SYSTEM

CROSS-REFERENCE TO RELATED APPLICATIONS

This application claims the benefit under 35 U.S.C. §119 (e) of U.S. Provisional Patent Application Ser. No. 61/786,881, filed Mar. 15, 2013.

BACKGROUND

This disclosure relates generally to bolt action systems for firearms. More particularly, this disclosure relates to straight pull bolt action systems.

A bolt action is a type of firearm action in which the weapon's bolt is operated manually by the opening and closing of the breech with a small handle. As the handle is operated, the bolt is unlocked, the breech is opened, the spent cartridge case is withdrawn and ejected, the firing pin is cocked (this occurs either on the opening or closing of the bolt, depending on design), and finally a new round/cartridge (if available) is placed into the breech and the bolt closed. Well-known examples of rifle bolt action systems are the Mauser system, the Lee-Enfield system and the Mosin-Nagant system.

Typically, the bolt consists of a tube of metal inside of which the firing mechanism is housed, and which has at the front or rear of the tube several metal knobs, or "lugs", which serve to lock the bolt in place. The most common locking method is a rotating bolt. The Mauser and Mosin-Nagant systems each have two lugs on the bolt head which lock to the receiver and the Lee-Enfield system has a lug and guide rib, which lock on the rear end of the bolt into the receiver.

SUMMARY

There is provided a straight pull bolt action system for use with a firearm including a receiver and a longitudinally extending barrel and a receiver. The bolt action system comprises a bolt, an action bar, a locking pin and a locking lug. The bolt has front and rear portions and a lower recess forming a locking surface. The bolt has an opening and is longitudinally moveable between a forward firing position and a rearward position. The action bar has front and rear portions, the rear portion having an L-shaped opening. The action bar is moveable between a forward position and a rearward position. The locking pin includes a first segment slidably disposed in the action bar L-shaped opening and a second segment slidably disposed in the bolt opening. The locking lug has oppositely disposed rear and front ends. The front end is pivotally vertically moveable between an up position and a down position. The locking lug front end is locked with the bolt locking surface when in the up position. Moving the action bar rearward from the action bar forward position pivots the locking lug front end downward from the up position whereby the bolt unlocks from the locking lug and is moved rearward by the action bar. Moving the action bar forward from the action bar rearward position moves the bolt forward from the bolt rearward position to the bolt forward firing position, the action bar pivoting the locking lug front end upward from the down position to the up position whereby the locking lug front end locks the bolt in the forward firing position.

The straight pull bolt action system further comprises a bolt handle attached to the action bar.

The locking lug rear end is pivotally mountable to a rear end portion of the receiver. The locking lug rear end may include a transverse opening, with a pivot pin extending through the opening and the receiver.

The action bar L-shaped opening includes a horizontally extending first portion, the bolt being unlocked to the action bar when the locking pin first segment is disposed in the action bar L-shaped slot first portion.

The action bar L-shaped opening also includes a vertically extending second portion, the bolt being locked to the action bar when the locking pin first segment is disposed in the action bar L-shaped slot second portion.

The locking lug engages the locking pin when the action bar is moved forward from the action bar rearward position, wherein pivoting the locking lug front end upward moves the locking pin first segment upward within the action bar L-shaped slot second portion into the action bar L-shaped slot first portion, whereby the bolt is unlocked from the action bar.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION

Figure 1:
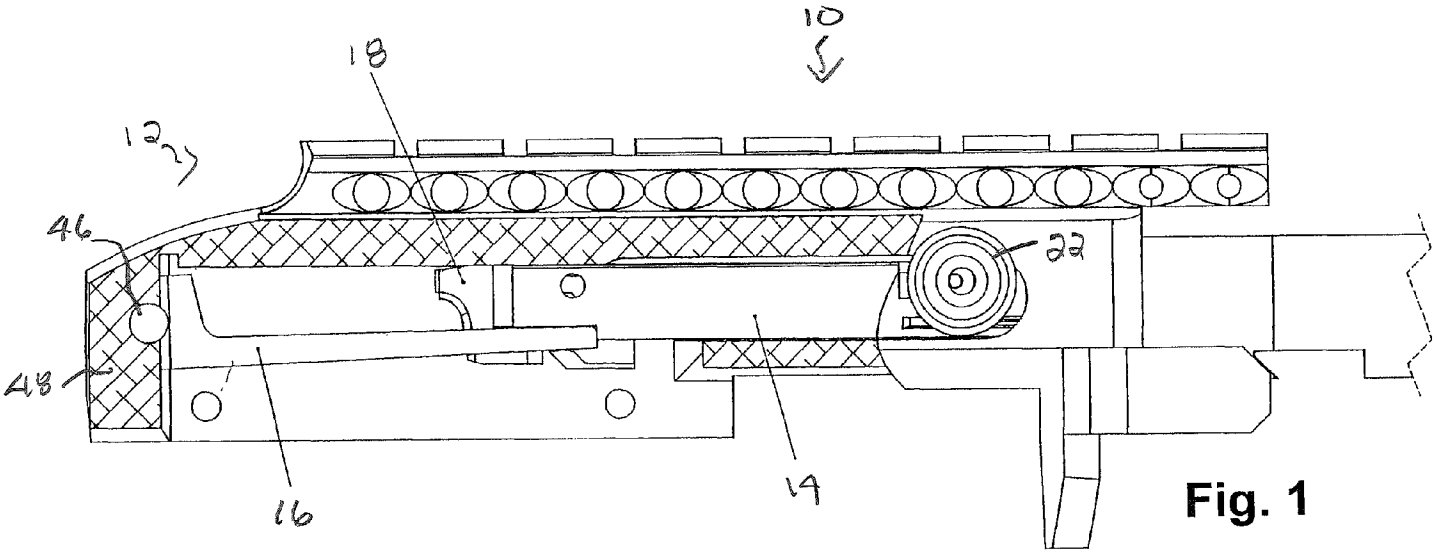
FIG. 1 is a right-side view, partially in phantom, of a straight pull bolt action system in accordance with the disclosure showing the bolt in a closed position.
Figure 2:
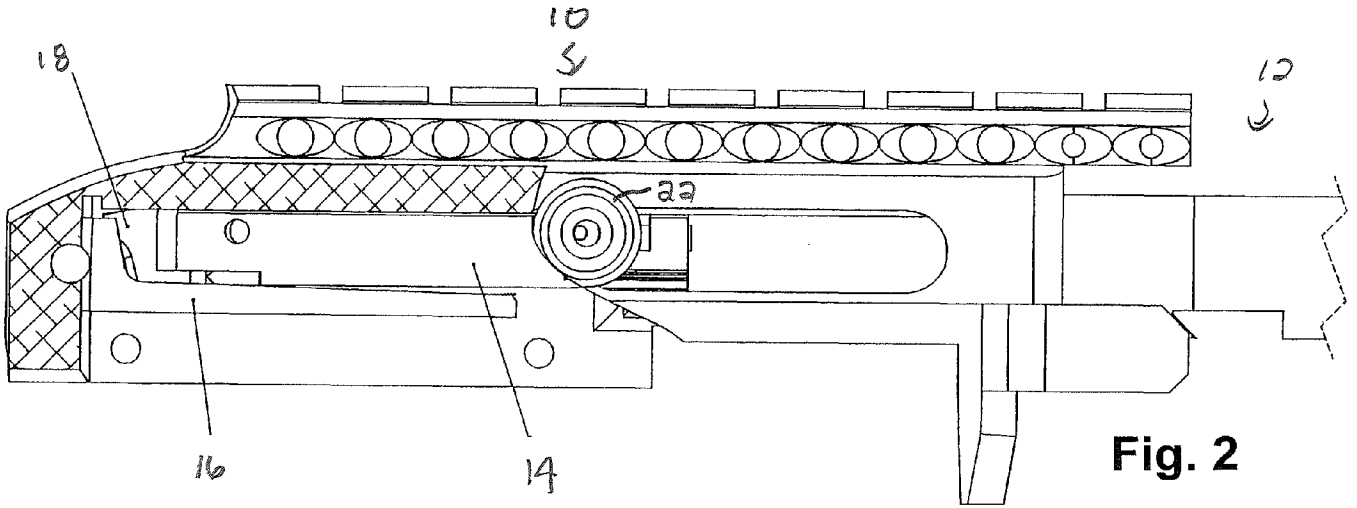
FIG. 2 is a right-side view, partially in phantom, of the straight pull bolt action system of FIG. 1 showing the bolt in an open position.
Figure 3:
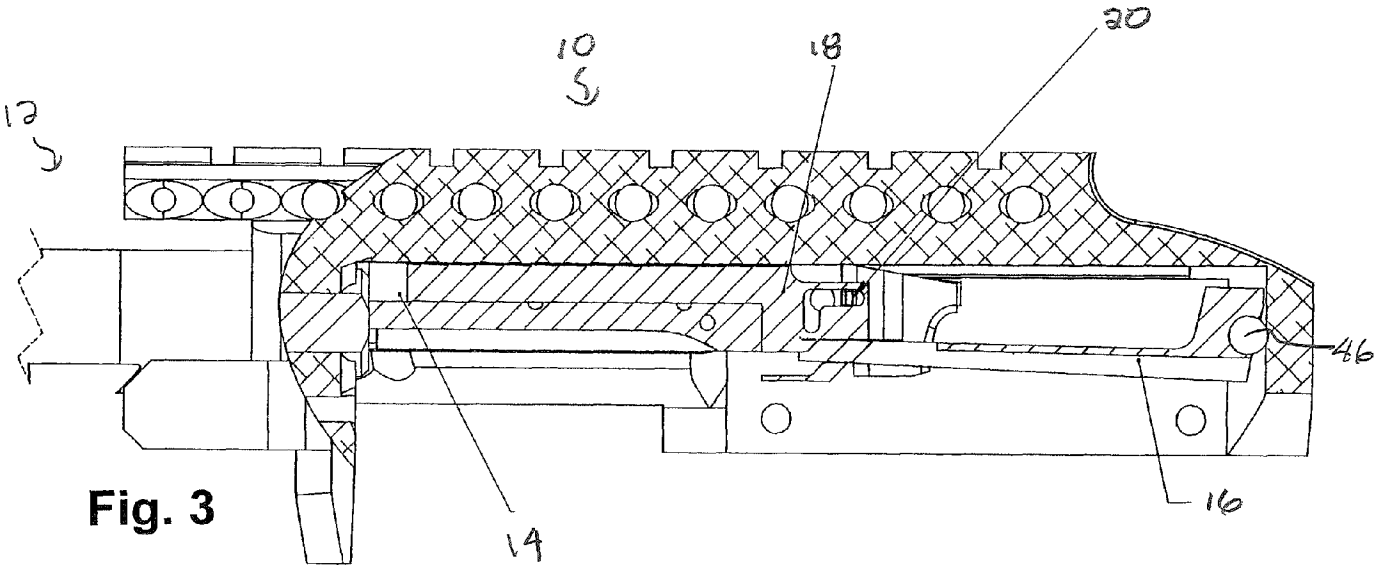
FIG. 3 is a left-side view, partially in phantom, of the straight pull bolt action system of FIG. 1 showing the bolt in a closed position.
Figure 4:
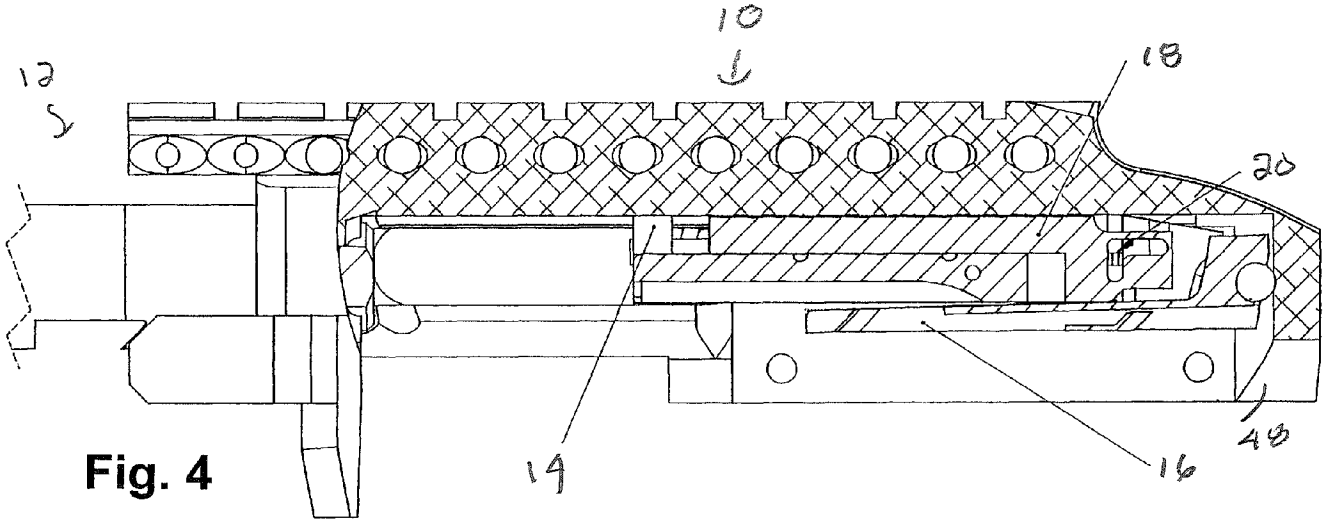
FIG. 4 is a left-side view, partially in phantom, of the straight pull bolt action system of FIG. 1 showing the bolt in an open position.
Figure 5:
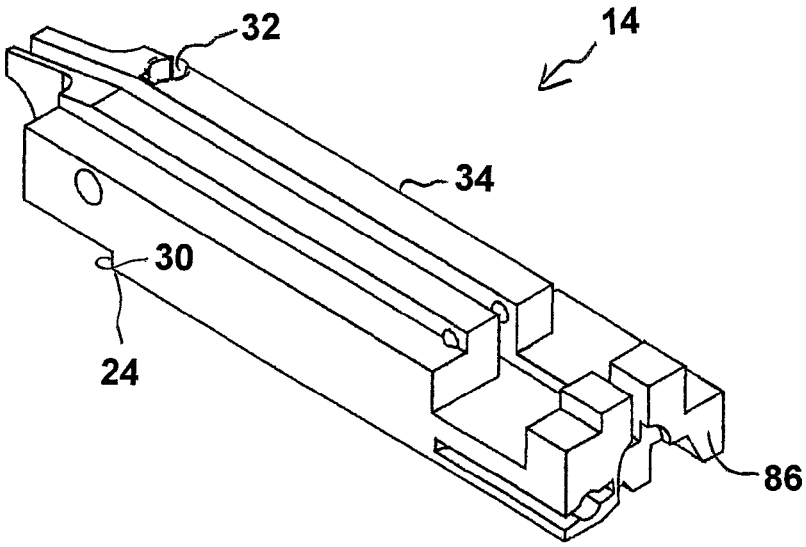
FIG. 5 is a perspective view of the bolt of the straight pull bolt action system of FIG. 1.
Figure 6:
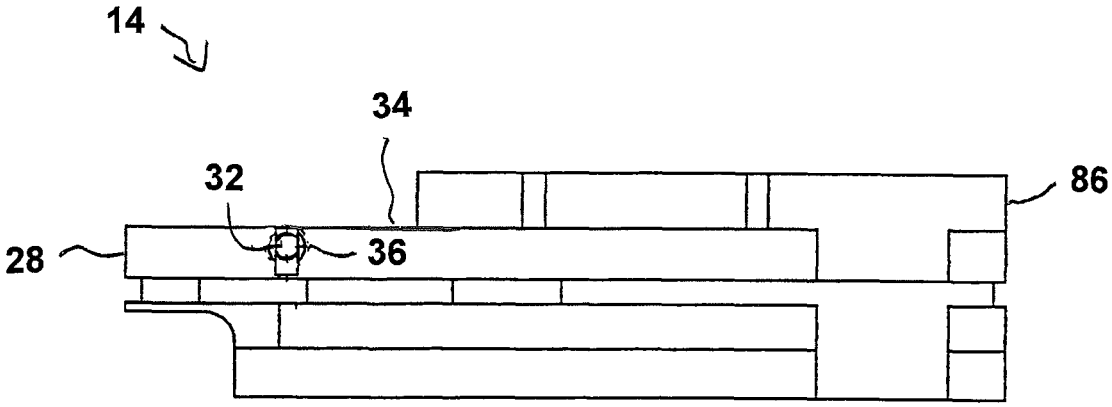
FIG. 6 is a top view of the bolt of FIG. 5.
Figure 7:
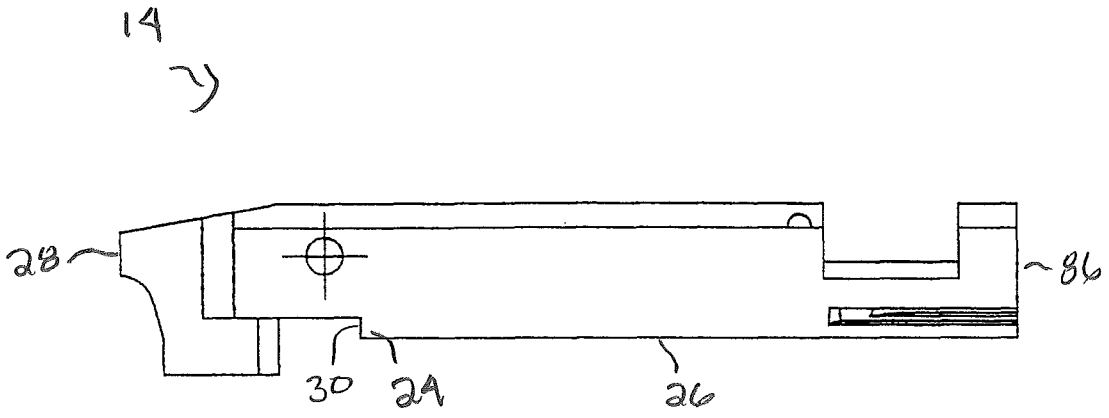
FIG. 7 is a side view of the bolt of FIG. 5.
Figure 8:
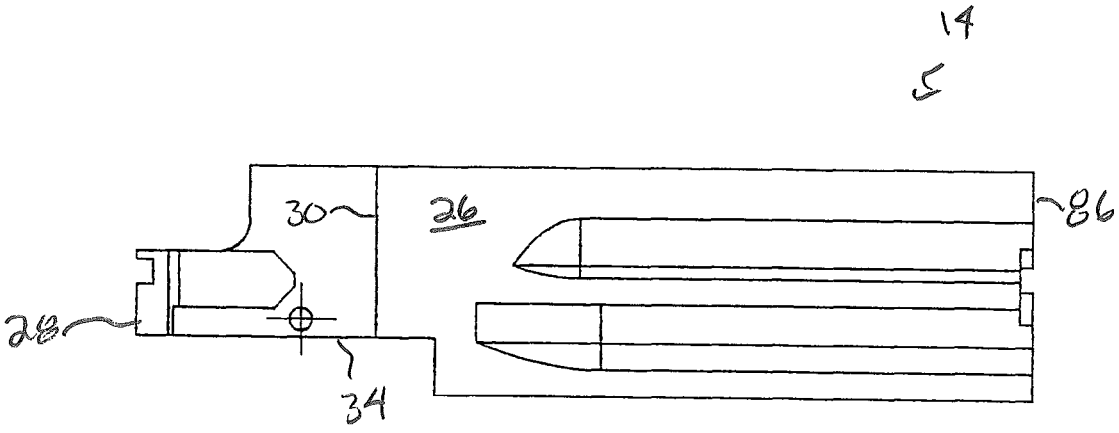
FIG. 8 is a bottom view of the bolt of FIG. 5.
Figure 9:
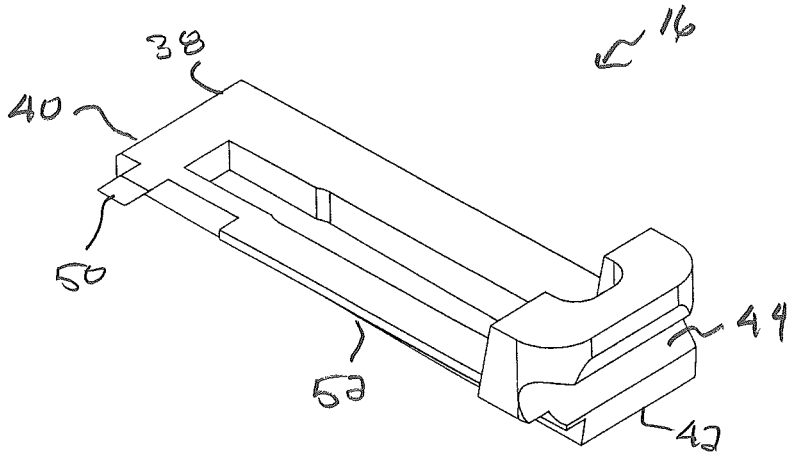
FIG. 9 is a perspective view of the pivoting locking lug of the straight pull bolt action system of FIG. 1.
Figure 10:
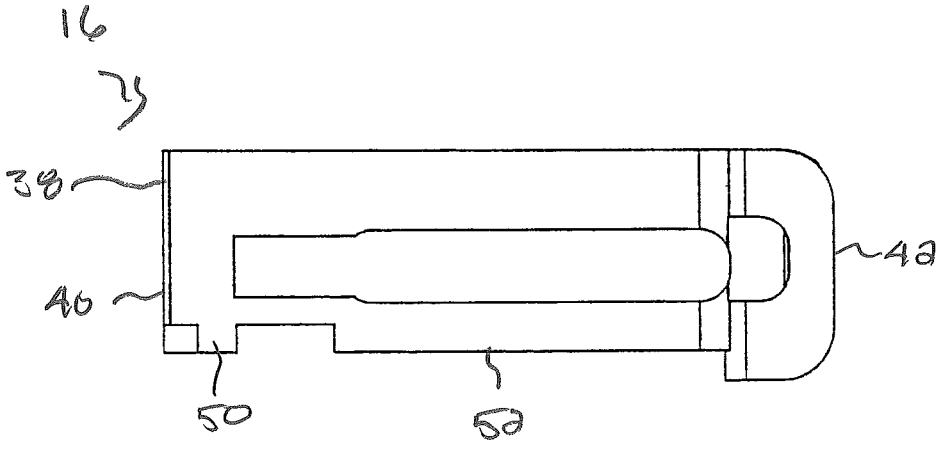
FIG. 10 is a top view of the pivoting locking lug of FIG. 9.
Figure 11:
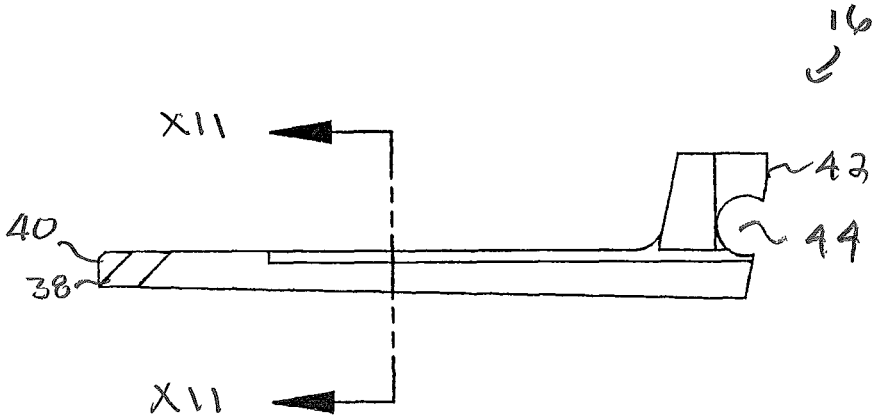
FIG. 11 is a side view of the pivoting locking lug of FIG. 9.
Figure 12:
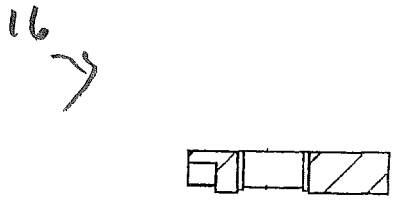
FIG. 12 is a cross-section view taken along line XII-XII of FIG. 11.
Figure 13:
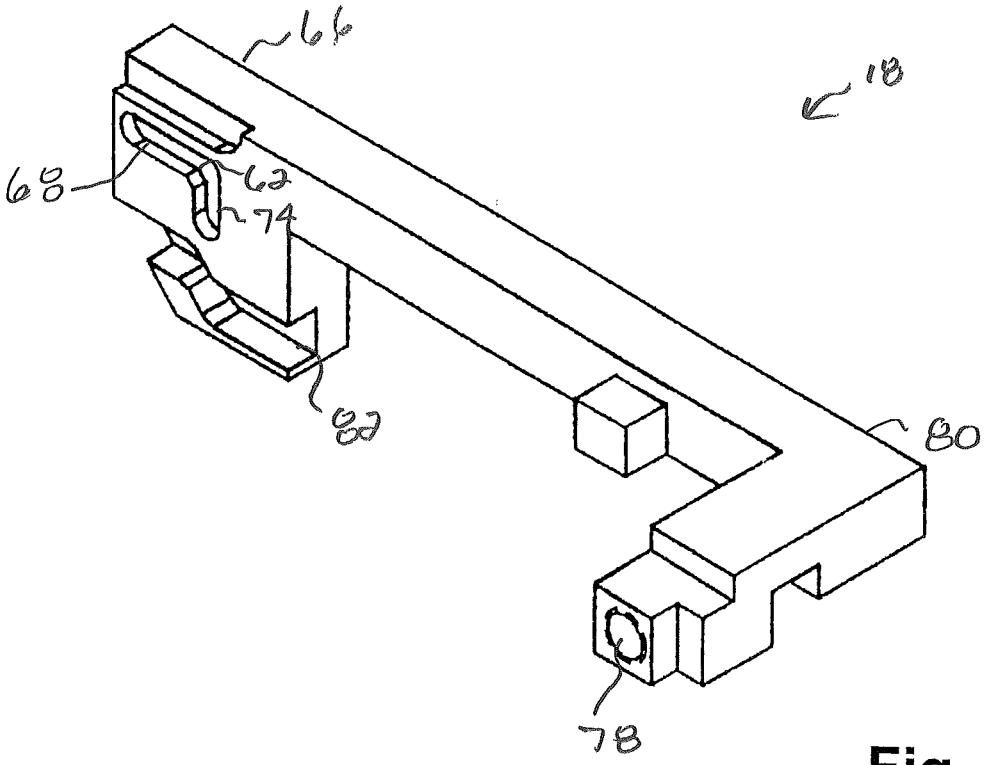
FIG. 13 is a perspective view of the bolt action bar of the straight pull bolt action system of FIG. 1.
Figure 14:
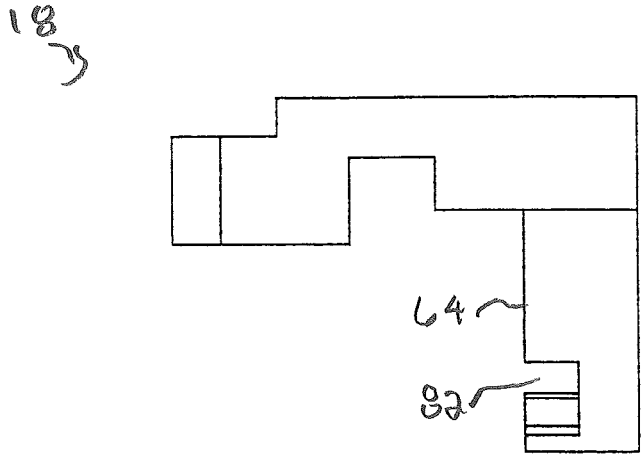
FIG. 14 is an end view of the bolt action bar of FIG. 13.
Figure 15:
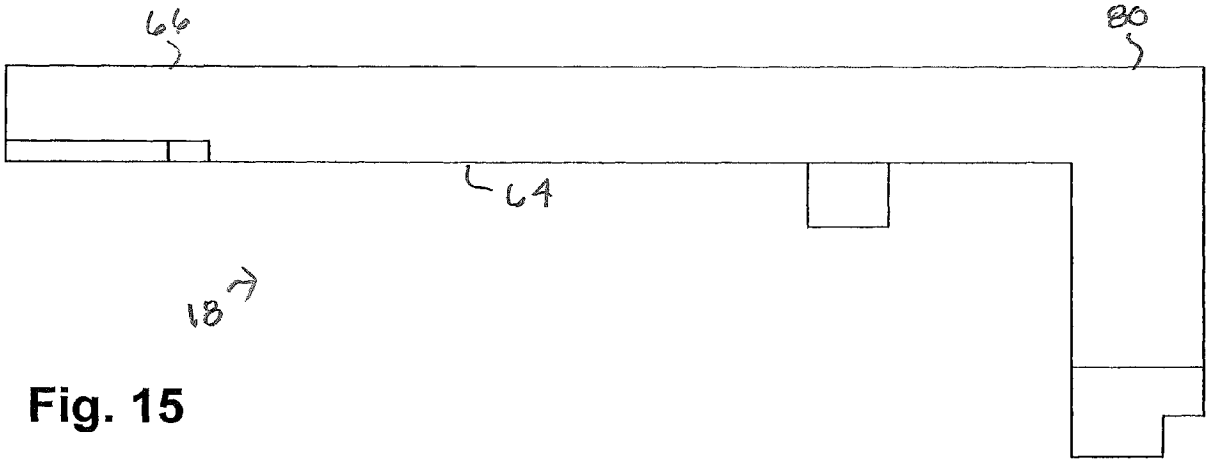
FIG. 15 is a top view of the bolt action bar of FIG. 13.
Figure 16:
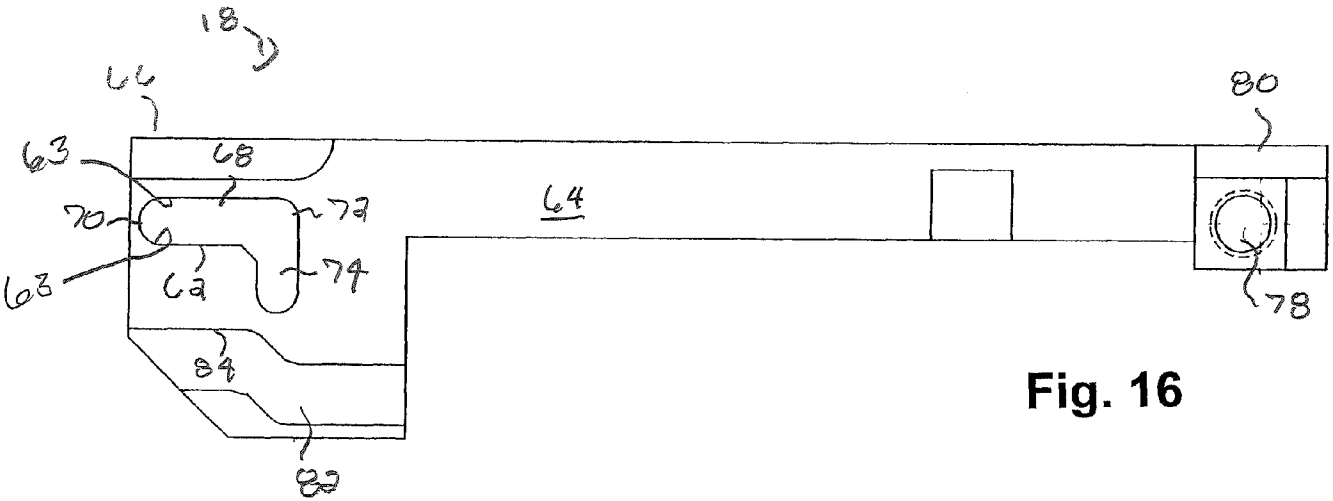
FIG. 16 is a side view of the bolt action bar of FIG. 13.
Figure 17:
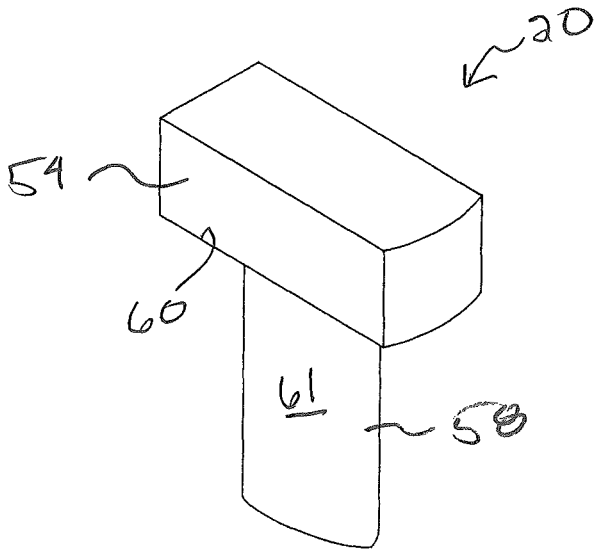
FIG. 17 is a perspective view of the action bar lock pin of the straight pull bolt action system of FIG. 1.
Figure 18:
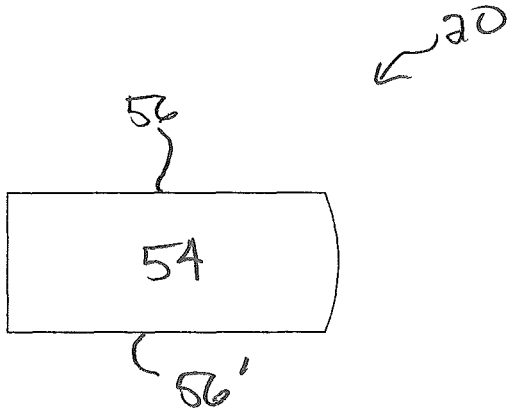
FIG. 18 is a top view of the action bar lock pin of FIG. 17.
Figure 19:
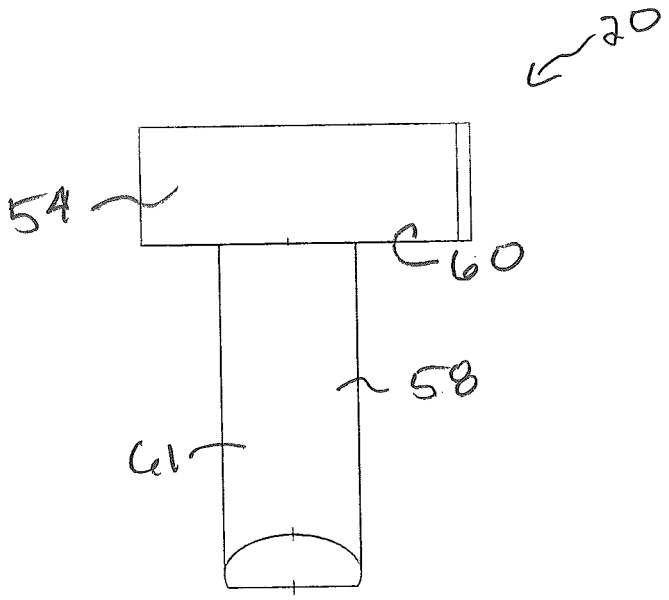
FIG. 19 is a front view of the action bar lock pin of FIG. 17.
Figure 20:
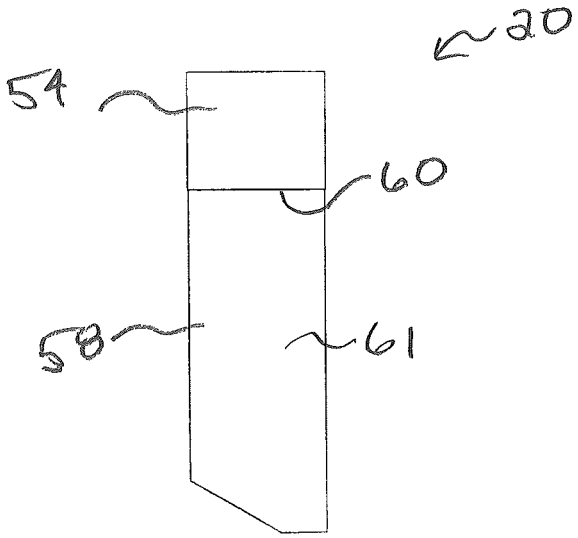
FIG. 20 is a left-side view of the action bar lock pin of FIG. 17.

With reference to the drawings, a straight pull bolt action system 10 in accordance with the present disclosure is shown installed in a rifle 12. The subject straight pull bolt action system 10 is different from conventional bolt action rifles where the bolt handle pivots or turns the bolt in an upward motion, thus unlocking the bolt and allowing the action to be cycled. It is also very different from conventional cam actuated straight pull bolt action rifles where the bolt releases or actuates a cam that in turn unlocks the bolt locking lug or lugs and allows the action to be cycled in a straight back and forth motion.

With reference to FIGS. 1-4, the subject straight pull bolt action system 10 includes a bolt 14, a pivoting locking lug 16, a bolt action bar 18, an action bar lock pin 20 and a bolt handle 22. With reference to FIGS. 5-8, a shoulder 24 on the bottom 26 of the bolt 14 proximate to the breech end 28 forms a first locking surface 30, a recess 32 extending from the left side 34 of the bolt 14 proximate to the breech end 28 has an inner surface forming a second locking surface 36.

With reference to FIGS. 9-12, the muzzle end 38 of the locking lug 16 forms a contact surface 40 and the breech end portion 42 of the locking lug 16 has a transverse opening 44. A pivot pin 46 extends through the opening 44 and the receiver 48 to pivotally attach the locking lug 16 to the inside rear of the receiver 48 (FIGS. 1-4). A cam 50 extends from the left side 52 of the locking lug 16 proximate to the muzzle end 38 of the locking lug 16. The locking lug contact surface 40 engages the bolt first locking surface 30 when the bolt 14 in the closed/firing position to lock the bolt 14 in the closed/firing position. The locking lug 16 secures the bolt 14 in its forward closed/firing position so that when a cartridge is fired all of the resulting thrust, pressure and energy created by the fired cartridge is absorbed by the locking lug 16.

The bolt 14 is connected to the bolt action bar 18 by the bar lock pin 20. With reference to FIGS. 13-20, the bar lock pin 20 includes a first segment 54 having oppositely disposed right and left sides defining contact surfaces 56, 56'. A second segment 58 extends downwardly from the bottom surface 60 of the first segment 54. The bar lock pin second segment 58 is slidably disposed in the bolt recess 32 whereby contact surface 61 contacts the bolt second locking surface 36. The bar lock pin first segment 54 is slidably disposed within a lock pin slot 62 extending from the right side 64 of the breach end portion 66 of the bolt action bar 18 whereby contact surfaces 56, 56' contact surfaces 63, 63'. The lock pin slot 62 includes an upper portion 68 that extends horizontally from a breech end 70 to a muzzle end 72 and a lower portion 74 that extends vertically from the upper portion muzzle end 72.

Figure 21:
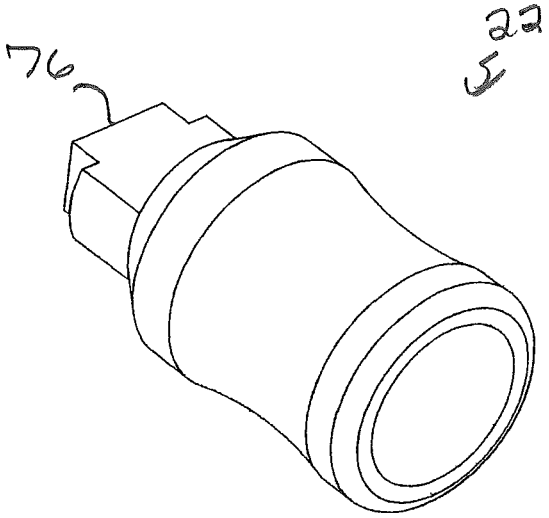
FIG. 21 is a perspective view of the bolt handle of the straight pull bolt action system of FIG. 1.

The distal end 76 (FIG. 21) of the bolt handle 22 is received in an opening 78 in the muzzle end portion 80 of the bolt action bar 18, and is securely attached therein. The locking lug cam 50 is slidably disposed within a cam slot 82 extending from the right side 64 of the breach end portion 66 of the bolt action bar 18. After a rifle having the subject straight pull bolt action system 10 is fired, the bolt handle 22 may be manually pulled straight back. As the bolt handle 22 moves the bolt action bar 18 rearward, contact between the locking lug cam 50 and the surface 84 of the bolt action bar cam slot 82 pivots the muzzle end 38 of the locking lug 16 down until the locking lug contact surface 40 clears the bolt locking surface 30, unlocking the bolt 14. When the bolt 14 is unlocked, continued rearward movement of the bolt handle/bolt action bar 22, 18 causes the spent cartridge case to be ejected.

After the spent cartridge case has been ejected, manually moving the bolt handle/bolt action bar 22, 18 forward also moves the bolt 14 forward, causing the bolt 14 to pick up and feed a new cartridge from the magazine into the chamber in the barrel of the rifle. When the muzzle end 86 of the bolt 14 contacts the breech of the barrel, continued forward movement of the bolt handle/bolt action bar 22, 18 causes contact between the locking lug cam 50 and the surface 84 of the bolt action bar cam slot 82. This contact pivots the muzzle end 38 of the locking lug 16 up until the locking lug 16 engages the bar lock pin 20, moving the bar lock pin first segment 54 upward within the lock pin slot lower portion 74 until the bar lock pin first segment 54 enters the lock pin slot upper portion 68, releasing the bolt action bar 18 from the bolt 14. Continued forward movement of the bolt handle/bolt action bar 22, 18 causes the bar lock pin first segment 54 to move forward within the lock pin slot upper portion 68 and the muzzle end 38 of the locking lug 16 to pivot upward until the locking lug contact surface 40 contacts the bolt locking surface 30. The bolt 14 is then securely locked with a loaded round in the chamber in the ready-to-fire position.

The operation of the bolt 14, action bar 18, locking lug 16 and bar lock pin 20 is unique to the subject straight pull bolt action system 10. The bar lock pin second segment 58 is vertically slidably movable within the bolt recess 32 with a spring (not shown) biasing the bar lock pin second segment downward, locking the action bar 18 to the bolt 14 as the bolt 14 is initially manually moved forward from the open position. After the bolt 14 is moved to its forward most position the pivoting locking lug cam 50 engages the bar lock pin 20 to release the action bar 18 from the bolt 14, allowing the action bar 18 to complete its forward motion and complete the pivoting locking lug movement to lock the firearm into the ready to fire position.

It should be appreciated that the subject straight pull bolt action system 10 may be used in a rifle or handgun. The straight pull bolt action system 10 may be used in rimfire or centerfire calibers and cartridges. The straight pull bolt action system may be used in a hammer or hammerless (Striker fire) design.

It will also be appreciated that various of the above-disclosed and other features and functions, or alternatives thereof, may be desirably combined into many other different systems or applications.

What is claimed is:

1. A straight pull bolt action system for use with a firearm including a receiver and a longitudinally extending barrel having oppositely disposed breech and muzzle ends, the barrel breech end being mounted to the receiver, the bolt action system comprising:

a bolt having front and rear portions and a lower recess defining a locking surface, the bolt defining an opening and being longitudinally moveable between a forward firing position and a rearward position;

an action bar having front and rear portions, the rear portion defining an L-shaped opening, the action bar being moveable between a forward position and a rearward position;

a locking pin including a first segment slidably disposed in the action bar L-shaped opening and a second segment slidably disposed in the bolt opening;

a locking lug having oppositely disposed rear and front ends, the front end being pivotally vertically moveable between an up position and a down position, the locking lug front end being locked with the bolt locking surface when in the up position;

wherein moving the action bar rearward from the action bar forward position pivots the locking lug front end downward from the up position whereby the bolt unlocks from the locking lug and is moved rearward by the action bar; and wherein moving the action bar forward from the action bar rearward position moves the bolt forward from the bolt rearward position to the bolt forward firing position, the action bar pivoting the locking lug front end upward from the down position to the up position whereby the locking lug front end locks the bolt in the forward firing position.

2. The straight pull bolt action system of claim 1 further comprising a bolt handle attached to the action bar.

3. The straight pull bolt action system of claim 1 wherein the locking lug rear end is adapted to be pivotally mounted to a rear end portion of the receiver.

4. The straight pull bolt action system of claim 3 wherein the locking lug rear end defines a transverse opening and the system further comprises a pivot pin adapted to extend through the locking lug opening and through the receiver.

5. The straight pull bolt action system of claim 1 wherein the action bar L-shaped opening includes a horizontally extending first portion, the bolt being unlocked to the action bar when the locking pin first segment is disposed in the action bar L-shaped opening first portion.

6. The straight pull bolt action system of claim 5 wherein the action bar L-shaped opening also includes a vertically extending second portion, the bolt being locked to the action bar when the locking pin first segment is disposed in the action bar L-shaped opening second portion.

7. The straight pull bolt action system of claim 6 wherein the locking lug engages the locking pin when the action bar is moved forward from the action bar rearward position, wherein pivoting the locking lug front end upward moves the locking pin first segment upward within the action bar L-shaped opening second portion into the action bar L-shaped opening first portion, whereby the bolt is unlocked from the action bar.

8. A straight pull bolt action system for use with a firearm including a receiver and a longitudinally extending barrel having oppositely disposed breech and muzzle ends, the barrel breech end being mounted to the receiver, the bolt action system comprising:

a bolt having front and rear portions and a lower recess defining a locking surface, the bolt defining an opening and being longitudinally moveable between a forward firing position and a rearward position;

an action bar having front and rear portions, the rear portion defining an L-shaped opening including a horizontally extending first portion and a vertically extending second portion, the action bar being moveable between a forward position and a rearward position;

a locking pin including a first segment slidably disposed in the action bar L-shaped opening and a second segment slidably disposed the bolt opening, the bolt being locked to the action bar when the first segment is disposed in the action bar opening second portion and unlocked to the action bar when the first segment is disposed in the action bar opening first portion; and a locking lug having oppositely disposed rear and front ends, the rear end being adapted to be pivotally mounted to a rear end portion of the receiver, the front end being pivotally vertically moveable between an up position and a down position, the bolt locking surface being locked with the locking lug front end in the up position;

wherein moving the action bar rearward from the action bar forward position pivots the locking lug front end downward from the up position whereby the bolt unlocks from the locking lug and is moved rearward by the action bar; and wherein moving the action bar forward from the action bar rearward position moves the bolt forward from the bolt rearward position to the bolt forward firing position, the action bar pivoting the locking lug front end upward from the down position to the up position whereby the locking lug front end locks the bolt in the forward firing position.

9. The straight pull bolt action system of claim 8 wherein the locking lug rear end defines a transverse opening and the system further comprises a pivot pin adapted to extend through the locking lug opening and through the receiver.

10. The straight pull bolt action system of claim 8 wherein when the action bar is moved forward from the action bar rearward position and the locking lug front end pivots upward, the locking lug engages the locking pin and moves the locking pin first segment upward within the action bar L-shaped opening second portion into the action bar L-shaped opening first portion, whereby the bolt is unlocked from the action bar.

11. The straight pull bolt action system of claim 8 further comprising a bolt handle attached to the action bar.

* * * * *